United States Patent [19]

Minati

[11] Patent Number: 4,779,884

[45] Date of Patent: Oct. 25, 1988

[54] PORTABLE TABLE FOR A WHEELCHAIR

[76] Inventor: Frank E. Minati, 521 E. Prospect, Kewanee, Ill. 61443

[21] Appl. No.: 39,305

[22] Filed: Apr. 17, 1987

Related U.S. Application Data

[63] Continuation of Ser. No. 838,463, Mar. 11, 1986.

[51] Int. Cl.[4] ..... A47B 83/02

[52] U.S. Cl. ..... 280/289 WC; 297/150; 297/155; 297/DIG. 4

[58] Field of Search ..... 280/289 WC, 242 WC, 280/657; 297/144, 145, 148, 150, 153, 154, 155, 161, 162, 173, DIG. 4; 108/112, 6

[56] References Cited

U.S. PATENT DOCUMENTS

| | | | |
|---|---|---|---|
| 1,231,301 | 6/1917 | Schlanger | 297/161 |
| 1,731,293 | 10/1929 | Chapman | 297/162 |
| 3,212,814 | 10/1965 | Anderson | 297/155 |
| 3,338,627 | 8/1967 | Frank | 297/153 |
| 3,632,161 | 1/1972 | Arfaras | 297/145 |
| 3,999,778 | 12/1976 | Markiel | 280/289 WC |
| 4,153,264 | 5/1979 | Pfister | 280/47.26 |
| 4,428,616 | 1/1984 | Hamilton | 297/155 |
| 4,566,732 | 1/1986 | Ostergaard | 297/155 |

FOREIGN PATENT DOCUMENTS

| | | | |
|---|---|---|---|
| 2309572 | 2/1973 | Fed. Rep. of Germany | 297/148 |
| 12376 | of 1908 | United Kingdom | 297/155 |
| 1188899 | 4/1970 | United Kingdom | 297/148 |

*Primary Examiner*—John J. Love
*Assistant Examiner*—Everett G. Diederiks, Jr.
*Attorney, Agent, or Firm*—Niro, Scavone, Haller, & Niro, Ltd.

[57] ABSTRACT

A portable table for a wheelchair storable adjacent the frame of the wheelchair. The portable table is attached to the frame of the wheelchair and includes a tilting device for varying the angle of the table top relative to the horizontal. The table top is also slidably connected to the wheelchair frame enabling lateral movement, as well as tilting of the table top relative to the horizontal. The table top includes foldable sections held together by a magnetic retaining device until the sections are separated by the user.

9 Claims, 2 Drawing Sheets

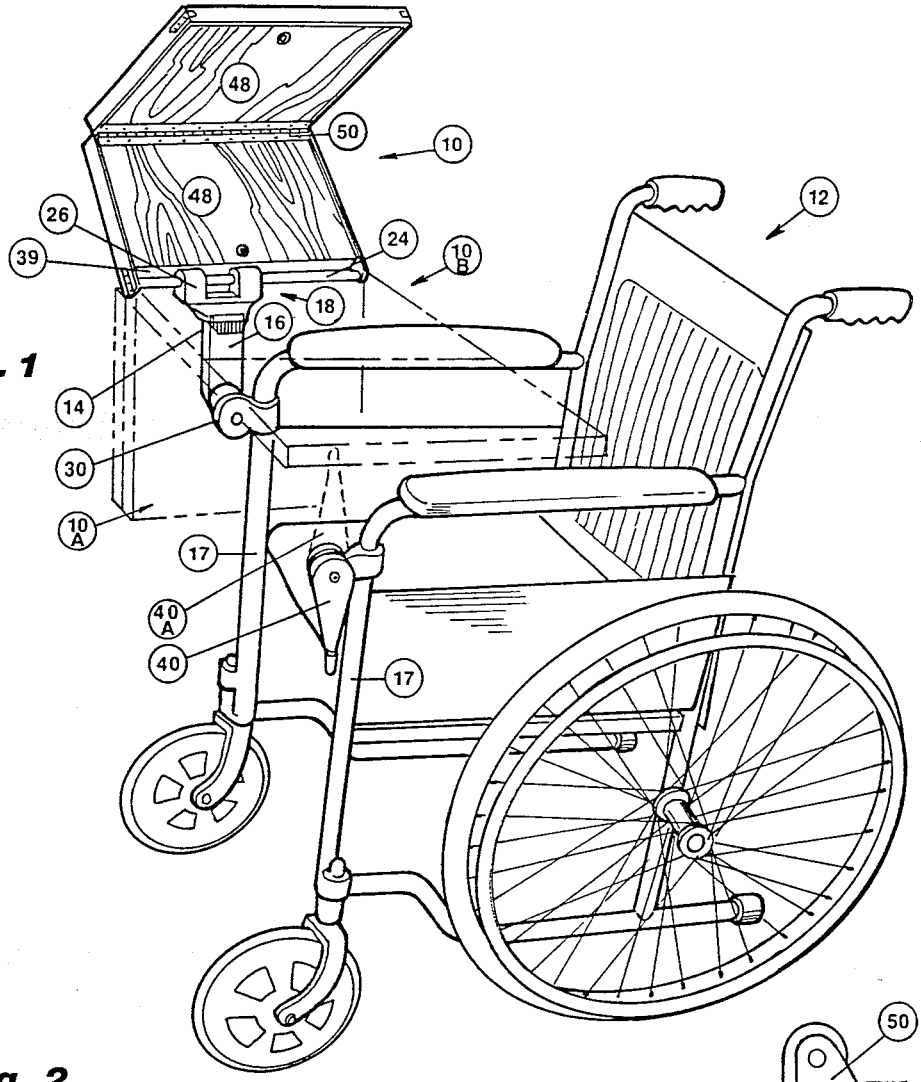
Fig. 1
Fig. 2
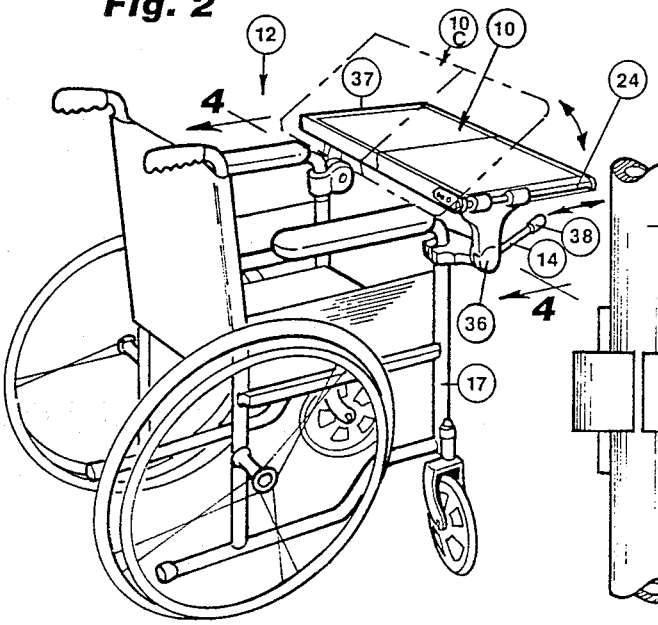
Fig. 3
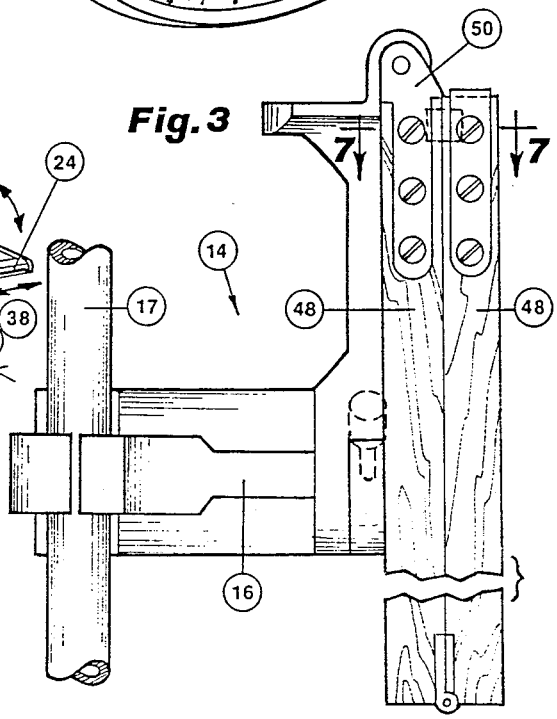

Fig. 4
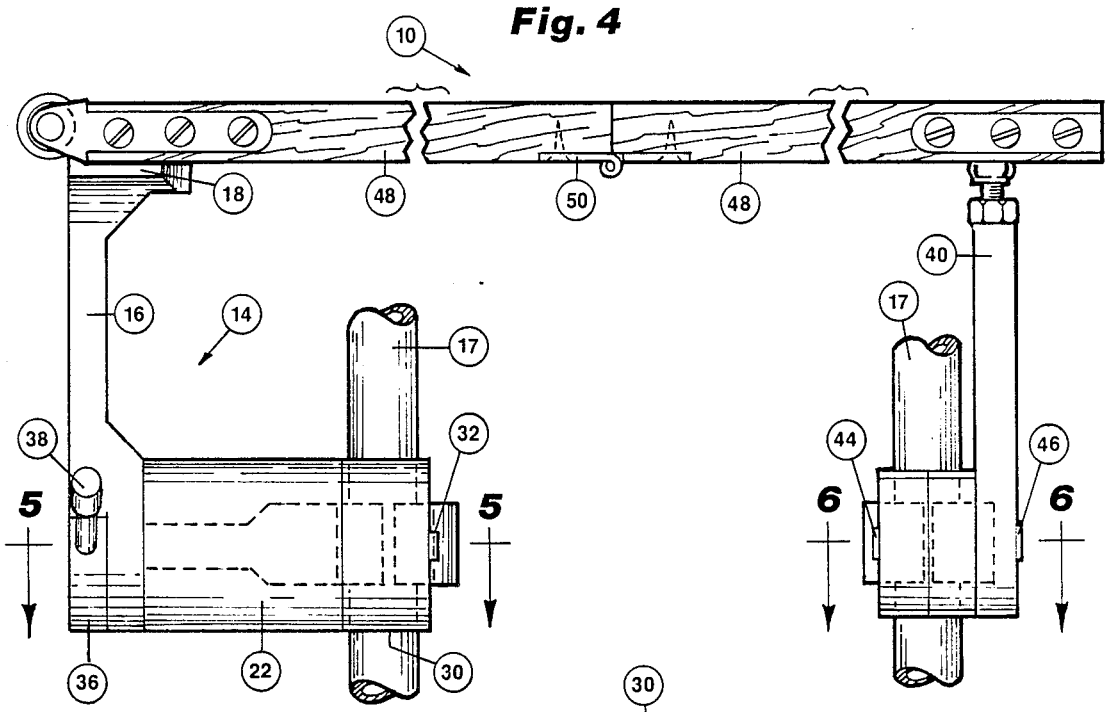
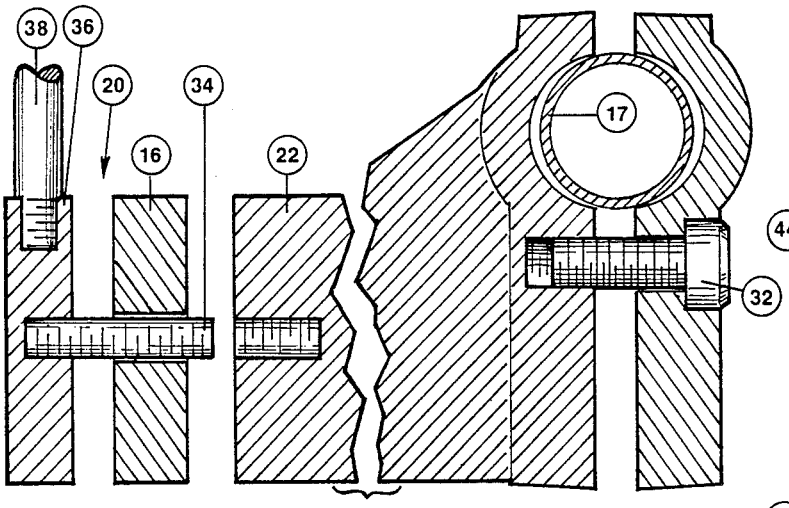
Fig. 5
(EXPLODED SECTION)
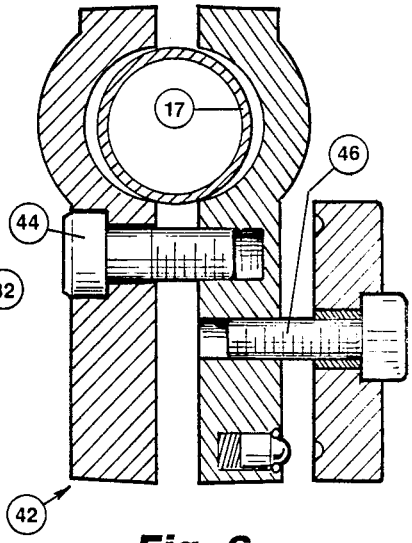
Fig. 6
(EXPLODED SECTION)
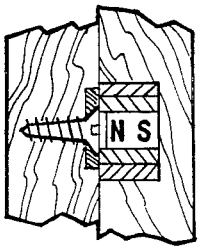
Fig. 7

PORTABLE TABLE FOR A WHEELCHAIR

This is a continuation of co-pending application Ser. No. 838,463 filed on Mar. 11, 1986.

BACKGROUND OF THE INVENTION

The present invention relates generally to a table top attachable to a wheelchair. More particularly, the invention relates to a portable wheelchair table storable closely adjacent the wheelchair frame and having a table top laterally adjustable by the user and further adapted for tilting relative to the horizontal.

Portable table tops used with various chairs currently include: detachable trays coupled to chairs by clips, table trays having supporting structural members adapted for sliding into arm conduits on a chair, and table tops which fold down from chairs positioned in front of another chair, such as for example, table tops for use with airline seats. The detachable variety of trays must be stored when not in use and are thus not readily accessible when needed. The fold-down table tops necessarily require another chair or similar support structure positioned nearby which is unwieldy and impractical for wheelchair adaptation. Currently existing portable tables also are not readily adjustable in the horizontal plane and have no adaptability for tilting for special user applications.

BRIEF SUMMARY OF THE INVENTION

One of the primary objects of the present invention is to provide a novel portable table for use with a wheelchair.

A more particular object of the present invention is to provide an improved wheelchair table top adapted for storage closely adjacent the wheelchair frame.

It is another object of the invention to provide a novel wheelchair table adapted for lateral movement for adjustment by the user.

It is a further object of the invention to provide an improved table top for a wheelchair adapted for tilting with respect to the horizontal.

Further objects and advantages of the present invention, together with the organization and manner of operation thereof, will become apparent from the following detailed description of the invention and taken in conjunction with the accompanying drawings wherein like reference numerals designate like elements throughout the several views.

BRIEF DESCRIPTION OF THE DRAWINGS

FIG. 1 is a perspective view generally from the front of a wheelchair with a storable table top attached thereto;

FIG. 2 is a perspective view generally taken from the back of the wheelchair showing in phantom the table top in a tilted position;

FIG. 3 is a fragmentary side view of a folded portable table top and table coupling frame;

FIG. 4 is a fragmentary front view taken substantially along line 4—4 of FIG. 2;

FIG. 5 is an exploded, transverse sectional view taken substantially along line 5—5 of FIG. 4;

FIG. 6 is a transverse sectional view taken substantially along line 6—6 of FIG. 4; and FIG. 7 is a transverse sectional view taken substantially along line 7—7 in FIG. 3;

DESCRIPTION OF PREFERRED EMBODIMENTS

Referring now to the drawings and in particular to FIGS. 1 and 2, a storable table top constructed in accordance with one embodiment of the present invention is indicated generally at 10. Storable table top 10 is shown supported for use by a wheelchair 12. Attachment means, such as a table coupling frame 14, connects the storable table top 10 to the wheelchair 12. Frame 14 also acts as a support for supporting a free end of table top 10 for use The table coupling frame 14 includes a main frame 16, first coupling means (such as a first coupling 18), tilting means (such as a pivot coupling 20), and second coupling means (such as a second coupling 22). The main frame 16 is connected to the storable table top 10 by the first coupling 18. The main frame 16 is connected to a frame 17 of the wheelchair 12 by the second coupling 22.

The first coupling 18 shown in FIG. 1 not only connects the main frame 16 to the storable table top 10, but also enables the user to slide the storable table top 10 laterally, or parallel, to the horizontal for optimum user positioning. The first coupling 18 includes a rod 24 mounted lengthwise along one end of the storable table top 10 and bracket means, such as a bracket member 26, extending from the main frame 16 and having concentric passageways slidably surrounding the rod 24.

The second coupling 22, which couples the main frame 16 to the frame 17 of the wheelchair 10, is best shown in FIGS. 4 and 5. The second coupling 22 comprises a two part bracket 30 with a clamp bolt 32 for tightening the bracket 30 around the frame 17.

The pivot coupling 20 is shown in FIG. 5 and includes a threaded rod 34 disposed within the second coupling 22 and a retaining cap 36 for fixing the angular position of the main frame 16 relative to the horizontal. The threaded rod 34 passes through an opening in the end portion of the main frame 16; therefore, the threaded rod 34 is adapted for angular rotation relative to the frame 17. The retaining cap 36 is used to affix the threaded rod 34 at a user selected angle (see 10C in phantom in FIG. 2). In actual use the retaining cap 36 is threadedly loosened from the rod 34 to enable the user to position the storable table top 10 at the desired angle, and the cap 36 is tightened against the end portion of the main frame 16 to firmly set the angle. The retaining cap 36 further includes a retaining arm 38 to enable the user to apply a mechanical advantage for loosening and tightening the retaining cap 36. Provided the main frame 16 is of the proper height, the storable table top 10 can be laterally positioned, as well as tilted throughout the range of lateral travel (see FIG. 2). When using the tilting feature and/or the lateral positioning feature of the storable table top 10, there can be used stop means, such as a slidable clip 39 (see FIG. 1) for limiting movement of the storable table top 10 in the range of travel along the rod 24. The clip 39 is able to hold the storable table top 10 at the selected position along the rod 24. For example, when the storable table top 10 is in a tilted position, the clip 39 can prevent the table top 10 from falling to the bottom of the length of travel along the rod 24.

The storable table top 10 also can include a raised border or lip 37 (see FIG. 2) which is adopted for conveniently holding objects, such as, for example, pencils or paint brushes. The lip 37 would be particularly convenient when the storable table top 10 is being used in the tilted configuration.

The portable table top 10 is shown in phantom in FIG. 1 for two positions: a folded or closed position, indicated as 10A, and in an unfolded ready position, indicated as 10B. The storable table top 10 shown in full lines is in a partially folded position representative of the configuration between the ready position and closed position. Additional support of the portable table top 10 is provided by support means, such as a table support 40 attached to the frame 17 as shown in a front view in FIG. 4 and in a cross sectional view in FIG. 6. The table support 40 is affixed to the frame 17 by bracket portions 42, which are mechanically clamped around the frame 17 by bolts 44. The table support 40 also is rotatably mounted to the bracket portions 42 by a pivot bolt 46 which enables rotation between the position of support shown in phantom in FIG. 1 and the storage position (shown in full lines). Both the attachment means and the support means are vertically adjustable on the frame 17, enabling accommodation of different sizes of persons in the wheelchair 12 or for different uses.

Preferably the storable table top 10 has two foldable sections 48 connected by a hinge 50. The two foldable sections 48 are held in a closed, or folded, position by joining means, such as a magnetic retaining device 52 shown in FIG. 7.

Therefore, in accordance with the present invention, a portable table is provided which is readily storable adjacent the frame of the wheelchair and includes a tilting device for varying the angle of the table top relative to the horizontal. The storable table top is also slidably connectable to the wheelchair frame enabling lateral movement toward and away from the user as well as having the tilting feature. The compactness and versatility of the portable table provide important advantages over previously available tables for use in conjunction with wheelchairs.

While preferred embodiments of the present invention have been illustrated and described, it will be understood that changes and modifications may be made therein without departing from the invention in its broader aspects. Various features of the invention are defined in the following claims.

What is claimed is:

1. A portable table supported by a wheelchair for use therewith, comprising:

a wheelchair having a frame, a table top storable closely adjacent to the frame of said wheelchair; and attachment means for connecting said storable table top to said frame of said wheelchair, said attachment means comprising a main frame, first coupling means including a rod mounted lengthwise along one end of said storable table top, a bracket means extending from said main frame and slidably connected to said rod mounted on said storable table top, said storable table top including a free end opposite said rod for supporting said table top on said frame of said wheelchair, said table top being positionable in a predetermined range of travel of said bracket means along said rod, and second coupling means for connecting said main frame to the frame of said wheelchair, said second coupling means including tilting means for varying the angle of the table top relative to the horizontal when said table top is positioned for use.

2. The portable table as defined in claim 1 wherein said storable table top comprises at least two foldable sections having a hinge connection therebetween.

3. The portable table as defined in claim 2 wherein said foldable sections include joining means for keeping said foldable sections closed against one another until the operator separates said foldable sections for use .

4. The portable table as defined in claim 3 wherein said joining means comprises a magnetic retaining device.

5. The portable table as defined in claim 1 further including stop means for selectively limiting movement of said storable table top in the range of travel.

6. The portable table as defined in claim 1 wherein said tilting means comprises a threaded fastener disposed within said second coupling means, said main frame having an opening for receiving said threaded fastener; and retaining means for holding said threaded fastener at the user selected angular position of said second coupling means relative to said main frame, enabling the operator to orient said table top for selectable uses.

7. The portable table as defined in claim 1 further including support means coupled to the frame of said wheelchair for supporting the free end of said table top opposite the end connected to said first coupling means.

8. The portable table as defined in claim 7 wherein said attachment means and said support means are vertically adjustable on the frame of said wheelchair.

9. The portable table as defined in claim 1 further including a lip around the edge of said storable table top.

* * * * *